US005701878A

United States Patent [19]

Moore et al.

[11] Patent Number: 5,701,878

[45] Date of Patent: Dec. 30, 1997

[54] TOY GUN HAVING A TRIGGER ASSEMBLY FOR AIMING AND LAUNCHING A PROJECTILE FROM A FLEXIBLE APPENDAGE

[75] Inventors: Michael A. Moore, Cincinnati, Ohio; David R. Griffin, Morning View, Ky.; Jeffery Dubose, Cincinnati, Ohio

[73] Assignee: Hasbro, Inc., Pawtucket, R.I.

[21] Appl. No.: 652,373

[22] Filed: May 23, 1996

[51] Int. Cl.[6] ..... F41B 11/14

[52] U.S. Cl. ..... 124/67; 124/66; 124/83; 124/84; 446/330; 446/376; 446/390

[58] Field of Search ..... 124/56, 65, 66, 124/67, 69, 73, 83, 84; 446/330, 352, 353, 361, 376, 382, 390

[56] References Cited

U.S. PATENT DOCUMENTS

| | | | |
|---|---|---|---|
| 862,206 | 8/1907 | Sillman | 446/376 X |
| 1,262,004 | 4/1918 | Beachy | 124/65 |
| 1,649,072 | 11/1927 | McAllaster | 446/361 X |
| 2,241,576 | 5/1941 | Barton . | |
| 3,445,069 | 5/1969 | Druge | 124/73 X |
| 3,583,381 | 6/1971 | Eaton et al. | 124/73 |
| 3,739,764 | 6/1973 | Allport | 124/73 X |
| 4,307,533 | 12/1981 | Sims et al. . | |
| 4,345,578 | 8/1982 | Speer | 124/56 |
| 4,411,249 | 10/1983 | Fogarty et al. | 124/64 |
| 4,689,033 | 8/1987 | Droller et al. | 446/183 |
| 4,689,034 | 8/1987 | Dubois et al. | 446/309 |
| 4,703,892 | 11/1987 | Nadel . | |
| 5,086,749 | 2/1992 | Ekstrom | 124/73 X |
| 5,242,323 | 9/1993 | Rappaport | 446/180 |
| 5,267,549 | 12/1993 | Webber | 124/65 |
| 5,306,199 | 4/1994 | Locricchio | 446/177 |
| 5,377,655 | 1/1995 | Arad | 124/65 |
| 5,378,188 | 1/1995 | Clark | 446/330 |

FOREIGN PATENT DOCUMENTS

| | | | |
|---|---|---|---|
| 500196 | 12/1921 | France | 446/382 |
| 320738 | 9/1934 | Italy | 124/56 |
| 901135 | 7/1962 | United Kingdom | 446/330 |
| 2 174 312 A | 11/1986 | United Kingdom . | |

*Primary Examiner*—John A. Ricci

*Attorney, Agent, or Firm*—Marshall, O'Toole, Gerstein, Murray & Borun

[57] ABSTRACT

The toy gun disclosed includes a trigger mechanism for launching projectiles from a flexible tail or other appendage. The tail bends and compressed gas is released in response to pulling the trigger to its full extent so that the projectile is launched when the flexible tail is bent.

13 Claims, 6 Drawing Sheets

190
194
196
200
210
220
138
24
120
110
150
168
20
142
140
106
112
64
56
50
58
92
94
26
36
30
68
48
80
102
46
98
100
212
182
180
28
220
22
184
210

TOY GUN HAVING A TRIGGER ASSEMBLY FOR AIMING AND LAUNCHING A PROJECTILE FROM A FLEXIBLE APPENDAGE

This invention relates generally to toy guns for launching projectiles with compressed gas and particularly to a toy gun having means for simultaneously aiming the projectile from a flexible appendage and releasing compressed gas to launch the projectile.

BACKGROUND OF THE INVENTION

Numerous toy guns are available for launching projectiles such as foam darts or water. Most of these toy guns include conventional aiming devices such as sights fixed to a barrel. Others include articulated barrels having barrel-mounted mirrors to aid in sight alignment and aiming.

A water squirting device is disclosed in U.S. Pat. No. 4,703,892 which includes a bendable segmented body and a water tube extending from a reservoir in the rear to a tip in the front end. The front end can be aimed in any direction by hand while the rear reservoir is squeezed to squirt water out of the front end.

Other toys are known which include appendages that move in response to a remote actuator. For example, U.S. Pat. No. 5,378,188 discloses a toy action figure having tendons in the limbs thereof for effecting controlled bending of the limbs.

None of these toys provides continuing play value and challenges from using a remote actuator to both aim and launch a projectile from a bendable appendage. Thus, a toy gun that could simultaneously bend an appendage to aim a projectile and release a burst of compressed gas through the appendage to launch the projectile would provide novel play value and unique challenges for accurate launching of the projectiles.

SUMMARY OF THE INVENTION

The present invention provides novel play value and unique challenges in a toy gun including: a housing defining an internal space, a trigger for being pulled that is pivotally joined to the housing; a pressure means for releasing compressed gas in response to the trigger being pulled; a flexible hose having a proximate end fixed to the pressure means and for receiving pressurized gas from the pressure means to transfer the pressurized gas to a distal end of the flexible hose to launch a projectile; and means for bending the hose.

The toy gun's pressure means may include a cylinder disposed in the internal space of the housing; a piston slidably disposed in the cylinder, for being engaged in a cocked position and for compressing gas when released from the cocked position; and means for engaging the piston in the cocked position until the trigger is pulled.

The toy gun's means for bending the flexible hose may include tensioning means slidably disposed in the housing's internal space and fixed to the proximate end of the flexible hose, the tensioning means for sliding and pulling the flexible hose in response to the trigger being pulled; and a flexible tail having a proximate end spaced apart from the proximate end of the flexible hose and fixed to the housing, the flexible tail having a distal portion fixed to a distal portion of the flexible hose whereby pulling the trigger will slide the tensioning means and pull the proximate end of the flexible hose relative to the proximate end of the tail, apply tension to the flexible hose to pull on the distal portion of the tail, and bend the tail and hose.

The tensioning means may be the cylinder which is part of the pressure means. The toy gun may be configured so that the tail and hose will bend to a desired shape before the compressed gas is released. The desired shape may be a curve extending from the rear end of the housing and pointed forward over the top of the housing.

Another embodiment of the toy gun includes a housing having a front end and a rear end, and defining an internal space; a trigger pivotally joined to the housing and having means for being pulled; a cylinder disposed in the internal space, having means for sliding between the front end and the back end of the housing, and having a front end and a rear end; means for biasing the cylinder toward the rear end of the housing and sliding forward in response to the trigger being pulled; a piston disposed at least partially in the cylinder and slidable between the rear end of the cylinder and a cocked position at the front end of the cylinder, and including means for compressing gas in the cylinder when sliding toward the rear of the cylinder; a sear disposed in the internal space of the housing and slidable between a cocked position and a release position, and including means for releasably engaging the piston in the cocked position; a sear spring for biasing the sear toward the cocked position; a release mounted on the cylinder for sliding the sear toward the release position to disengage the sear from the piston in response to the trigger being pulled; a flexible hose for receiving compressed gas from the cylinder and transferring compressed gas to launch a projectile, the flexible hose having a proximate end fixed to the cylinder for sliding movement therewith and a distal portion spaced apart from the housing; and a tail fixed to the rear end of the housing and to the distal portion of the flexible hose, the tail having means for bending in response the cylinder sliding toward the front end of the housing.

DETAILED DESCRIPTION OF THE DRAWINGS

To the extent practical, the same or similar items depicted in the various drawings will be identified by the same numeral throughout the drawings.

Figure 1:
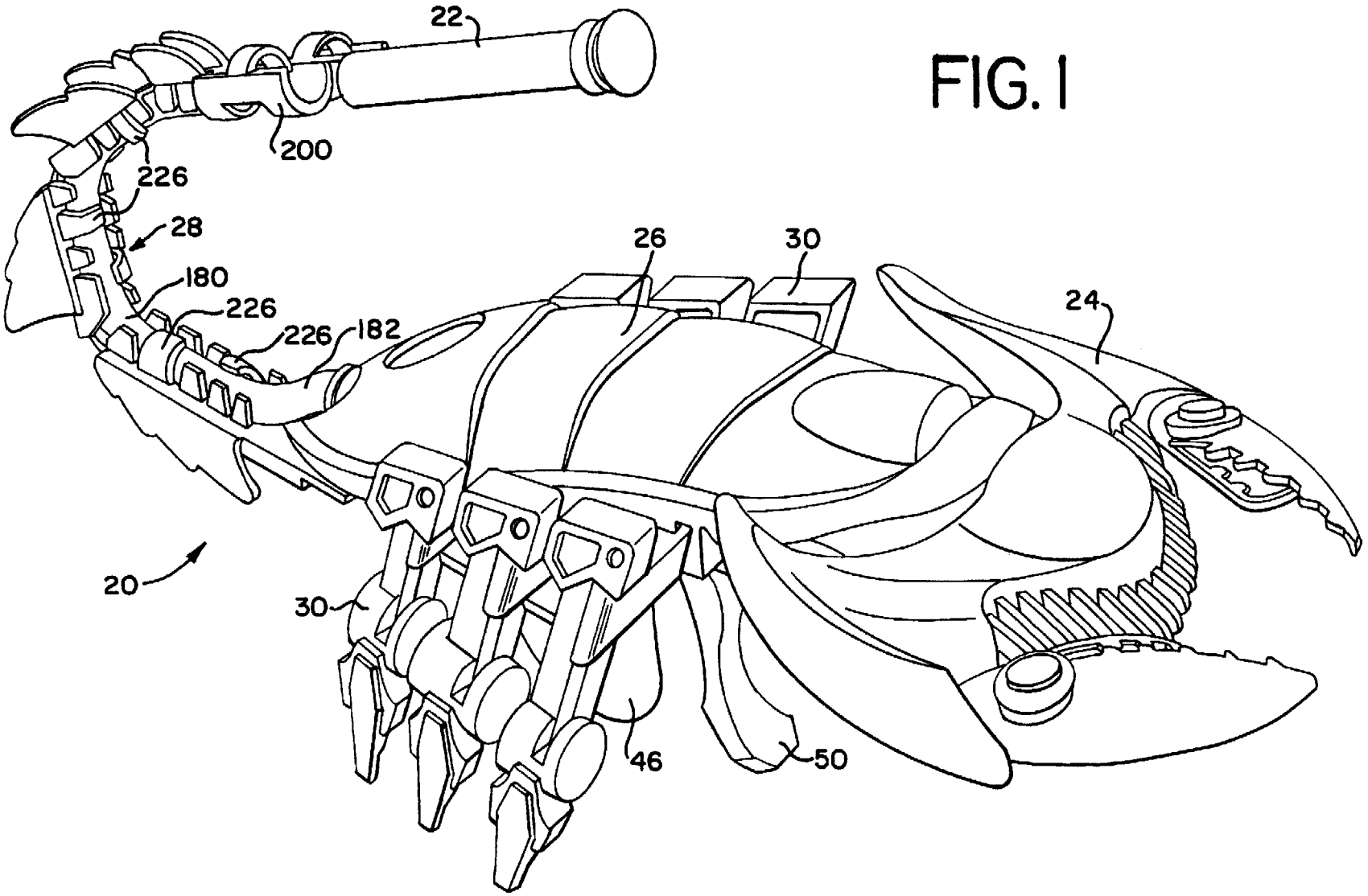
FIG. 1 is a perspective view of a toy gun in accordance with the present invention.

With reference to FIG. 1, there is depicted a toy air gun 20 for shooting foam darts 22 or other projectiles, including water. The gun 20, as illustrated, is in the stylized shape of a mechanized scorpion to enhance its play value. The gun 20 includes a head 24, body 26, tail assembly 28, and legs 30.

Figure 2:
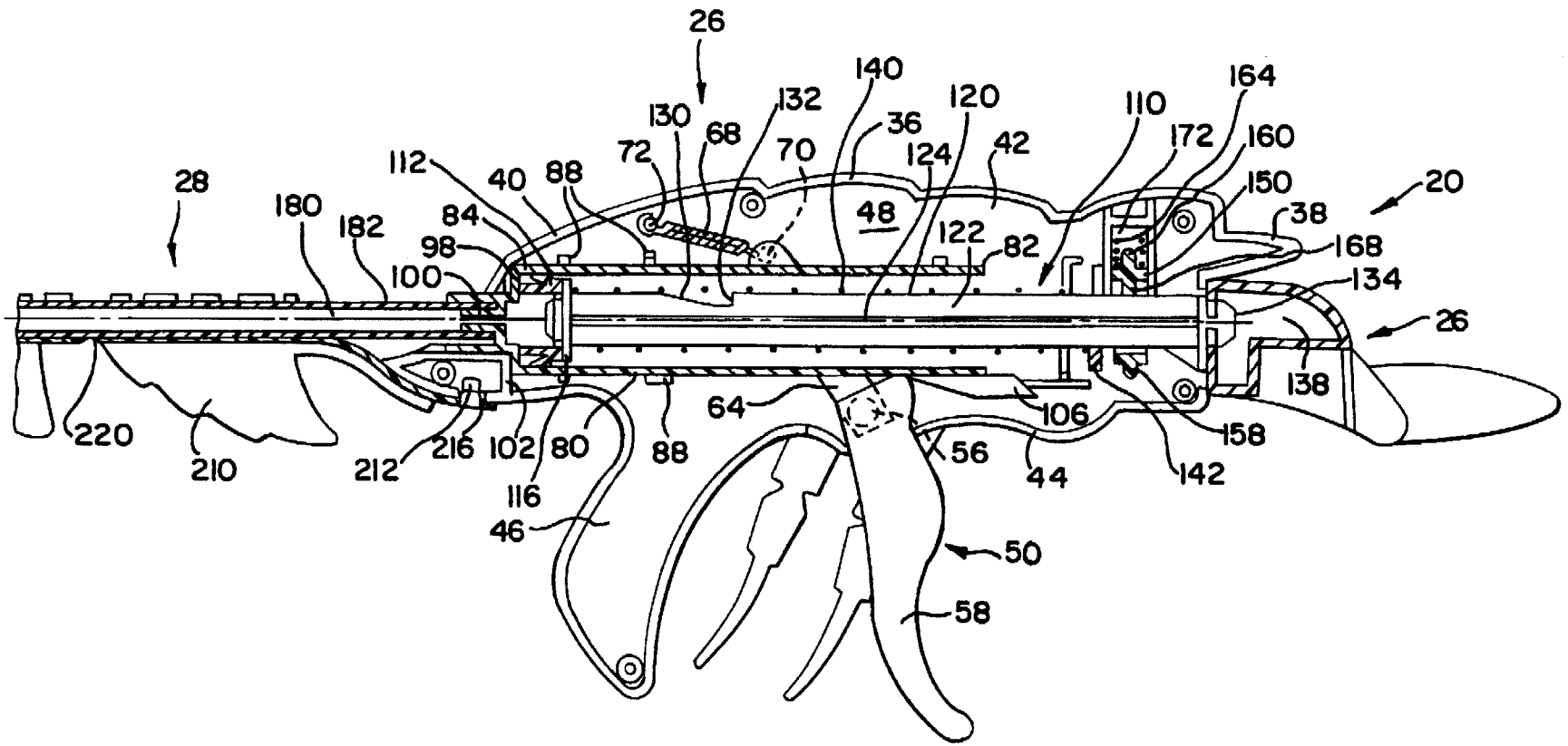
FIG. 2 is a partial cross-sectioned view of the toy gun in FIG. 1 in an uncocked position.
Figure 3:
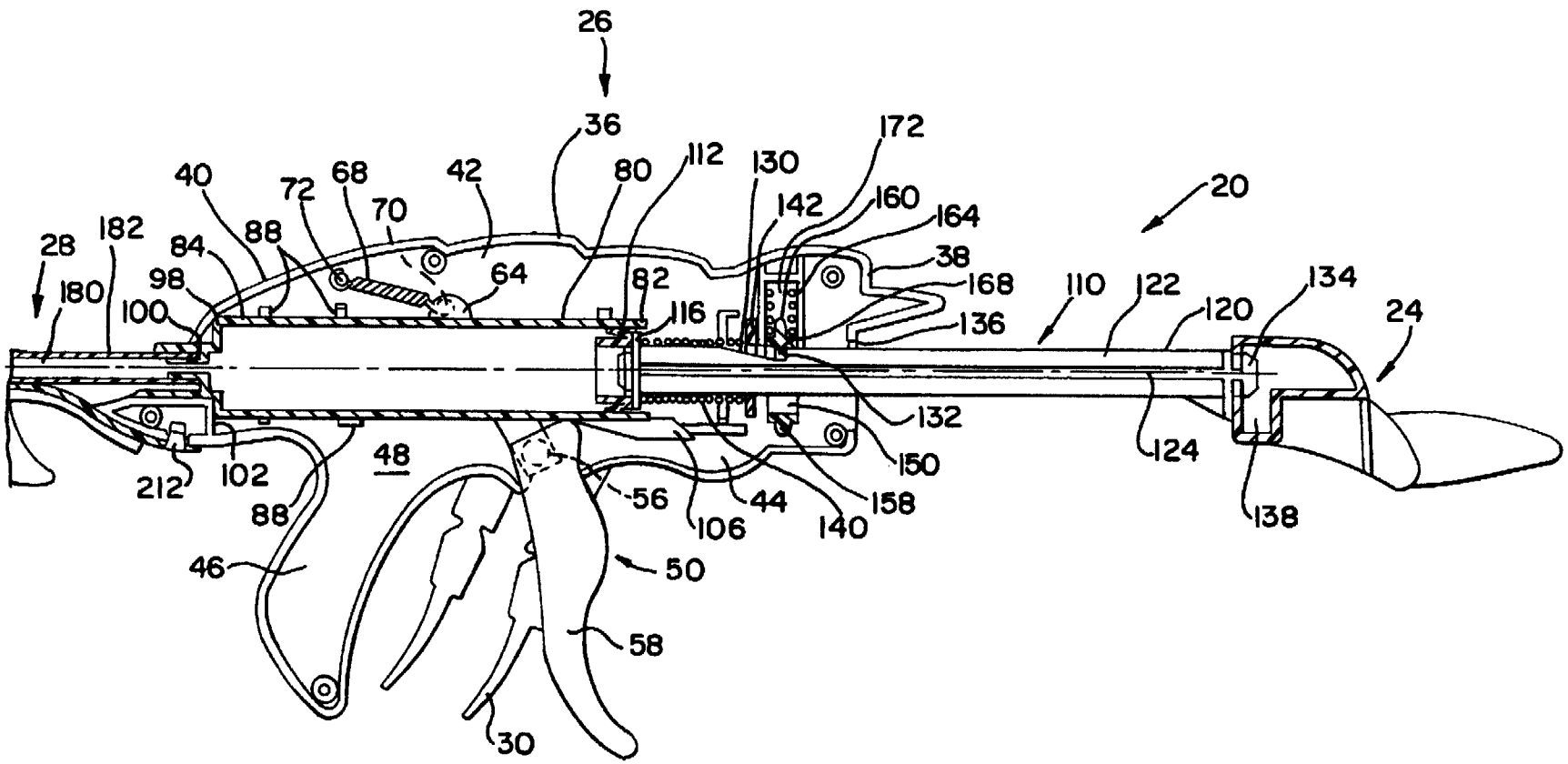
FIG. 3 is a partial cross-sectioned view of the toy gun in a cocked position.

As best illustrated in FIGS. 2 and 3, the body 26 is defined by a housing 36 which is assembled from two halves of molded plastic (preferably super high impact polystyrene (SHIP)) that may be screwed or sonic welded together. The gun 20 is depicted with the right half of the housing 36 removed to expose the working components. The housing 36 includes a front end 38, back end 40, top side 42, and under side 44. At the under side 44 of the housing 36 is a handle 46 extending downward for holding, firing, and aiming the gun 20 with one hand.

The housing 36 defines an internal space 48 in which some of the operative elements are contained. A trigger 50 is mounted to the housing 36 with a pair pivots 56 so that the fingers of the user's hand can grasp a lower portion 58 of the trigger 50 while the thumb remains on handle 46 to pull the trigger's lower portion 58 rearward. The pair of pivots 56 are preferably molded integrally with the trigger 50 and extend transversely. Sockets (not illustrated) in the housing receive the pivots 56 for rotational movement across an arcuate range. The trigger 50 is preferably made of high impact polypropylene (HIPP). A bifurcated upper portion 64 of the trigger 50 extends upward through the internal space 48 of the housing 36. A trigger spring 68 is attached at one of its ends in a conventional manner to a pin 70 on the upper portion 64 of the trigger 50, and the other end of the trigger spring 68 is attached to a peg 72 that is preferably molded integrally with the housing 36. In this manner, the upper portion 64 of the trigger 50 is biased rearward and the lower portion 58 of the trigger 50 is biased forward so that the trigger 50 will have its lower portion 58 in a normally forward position and a user will pull the lower portion 58 rearward to overcome the tension in the trigger spring 68 and pivot the upper portion 64 forward.

A cylinder 80 is slidably disposed in the internal space 48 of the housing 36 and between the bifurcated legs of the upper portion 64 of the trigger 50. The cylinder 80 is preferably made of SHIP, and has an open front end 82 and a partially closed rear end 84. The cylinder 80 is positioned within a number of guides 88 that are preferably molded integrally within the housing 36 and are sized and spaced to permit the cylinder 80 to slide between the housing front end 38 and the rear end 40 of the housing 36, but the cylinder 80 is restrained from moving vertically within the housing 36.

The cylinder 80 includes a pair of pivot pins 92 extending transversely from and molded integrally with the cylinder 80. The pivot pins 92 engage slots 94 in the trigger's upper portion 64 in the manner depicted best in FIGS. 4 and 5 so that the trigger spring 68 will normally bias the cylinder 80 rearward.

The cylinder 80 has at its rear end 84 an annular shoulder 98 and a take-off nipple 100 through which compressed gas may flow. The annular shoulder 98 bears on a back-stop 102 to define the rearward-most position of the cylinder 80. The back-stop 102 is fixed to the housing 36 and is preferably molded integrally therewith.

On the underside of the cylinder 80, is a ramped release 106 that extends forward beyond the front end 82 of the cylinder 80. The function on the ramped release 106 is described below.

Slideably disposed within the cylinder 80 is a piston 110 which has at its rear end a resilient seal 112, preferably made of low density poly-vinyl chloride (LPVC) that sized to be slightly compressed within the cylinder 80. Adjacent the seal 112 is a stop 116 that is preferably a split ring that snaps into a circumferential recess in the piston 110.

The piston 110 also includes a shaft 120, preferably made of SHIP, that extends forward from the stop 116. The shaft 120 preferably has a cross-shaped cross-section including a vertical bar 122 intersected by a horizontal bar 124. The vertical bar 122 includes a notch with a rear ramped portion 130 and a front vertical bearing surface 132 which has a function described below. The vertical bearing surface 132 is preferably wider than the vertical bar 122 to provide extra bearing surface and reduced wear on the vertical bar 122.

The front end 134 of the piston shaft 120 extends out of a matching cross-shaped opening 136 defined by the front end 38 of the housing 36. The front end 134 of the piston 110 has secured to it a handle 138, which in the illustrated embodiment is in the shape of a stylized scorpion head 24.

Fitted over the piston shaft 120 is a piston spring 140 that abuts the piston stop 116 in the rear and a washer 142 in the front. The diameter of the piston spring 140 is larger than the opening in the washer 142, and the outside diameter of the washer 142 is larger than the diameter of the cylinder 80. In this manner, the washer 142 can maintain the piston spring 140 on the shaft 120 even when the piston spring 140 is compressed in a cocked position (FIG. 3). Together, the cylinder 80 and the spring-loaded piston provide means for releasing compressed air for launching a projectile. Other means for releasing compressed gas may be used.

Figure 9:
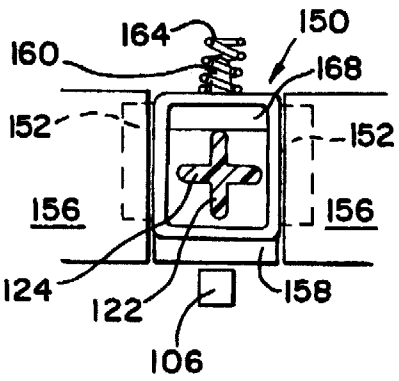
FIG. 9 is a cross-sectional view taken along line 9—9 in FIG. 7.
Figure 10:
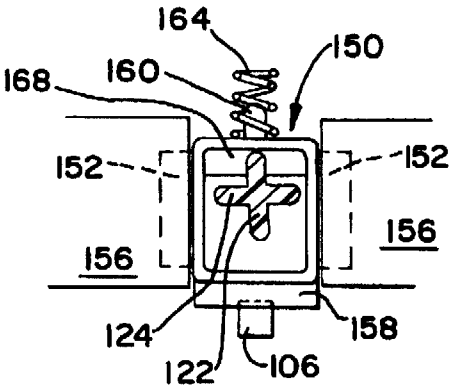
FIG 10 is a cross-sectional view taken along line 10—10 in FIG. 8.

Also positioned over the piston shaft 120 between the washer 142 and the handle 138 is a sear 150 (preferably made of celcon (CELN)) that interacts with the spring-loaded piston to release compressed gas in response to the trigger 50 being pulled. The sear 150 is best illustrated in FIGS. 9 and 10, and is box-shaped with vertical slides 152 extending transversely outward from the sear 150 to engage vertical slots 156 in the housing 36. With this arrangement, vertical movement of the sear 150 is possible, but movement in other directions relative to the housing 36 is restrained. At the bottom of the sear 150 is a horizontal bar 158 that is sized and positioned to engage the notch 128 in a manner described below. The top side of the sear 150 includes a spring post 160 extending upwardly from the sear 150. The sear spring 164 is positioned over the sear post 160 to bias the sear 150 downward so that a horizontal engagement bar 168 on the inside of the box-like sear 150 is in sliding contact with the vertical bar 122 of the piston shaft 120.

Figure 7:
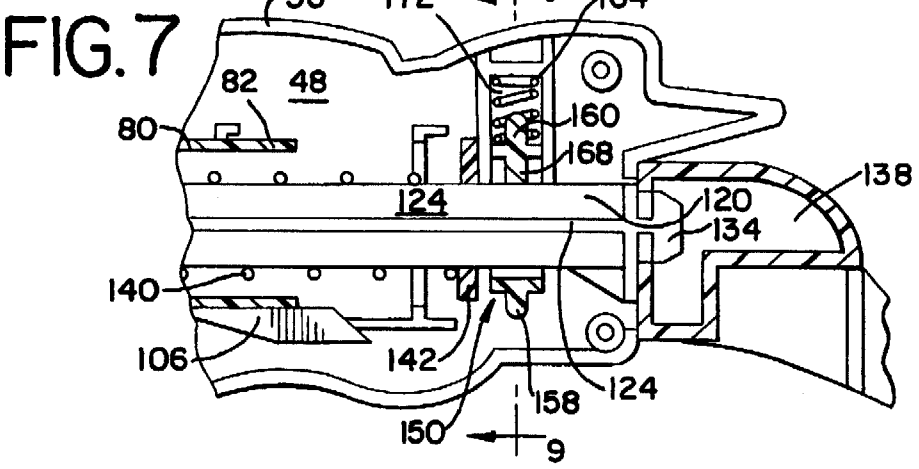
FIG. 7 is an enlarged partial cross-sectional view of a sear in an unengaged position in accordance with the present invention.
Figure 8:
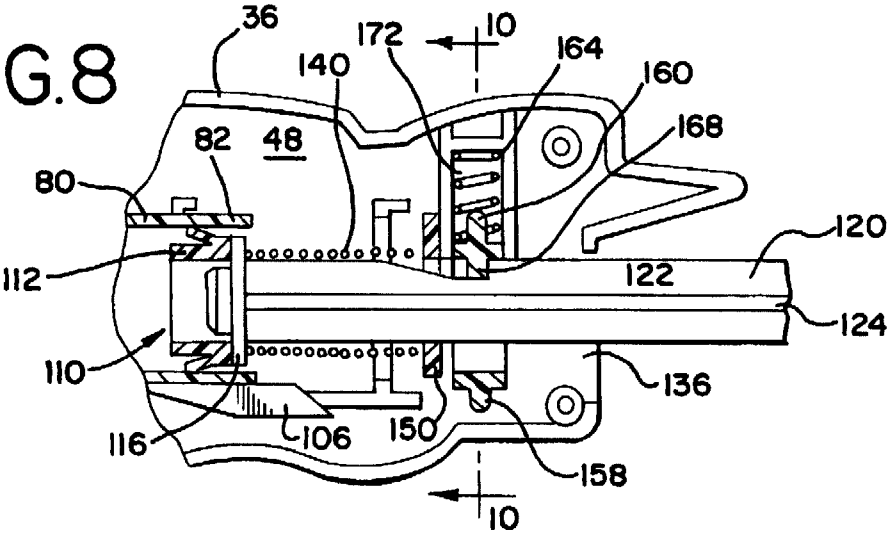
FIG. 8 is the partial cross-sectional view of FIG. 7 with the sear engaging a piston in a cocked position.

Referring back to FIGS. 7 and 8, it can be seen that the sear spring 164 is contained within a box-like recess 172 in the housing 36 to contain and prevent bending and twisting of the sear spring 164. The recess 172 also acts to limit forward movement of the piston spring washer 142 and compress the piston spring 140 in the cocked position (FIG. 3).

With this arrangement of the housing 30, the trigger 50, the cylinder 80, the piston 110, the sear 150, and the various springs it should be understood that in the normal condition illustrated in FIG. 2, the trigger's lower portion 58 will be biased forward, its upper bifurcated portion 64 will be biased rearward; the cylinder 80 and the piston 110 will be biased rearward, and the sear 150 will be biased downward.

FIG. 3 illustrates the gun 20 in a cocked position. To obtain this configuration, the operator pulls the handle 138 forward against the bias of the piston spring 140 until the vertical bearing surface 132 of the piston shaft 120 notch 128 clears the horizontal engagement bar 168 on the sear 150. At that point, sear spring 164 urges the sear 150 downward and the horizontal engagement bar 168 engages the vertical bearing surface 132 on the piston shaft 120 to prevent rearward movement of the piston 110 despite the urging of the piston spring 140. If the operator pulls the piston 110 too far forward, the sear 150 will still be urged downward in sliding contact with the rear ramp portion 130 of the piston shaft 120. When the piston 110 starts moving rearward, the sear engagement bar 168 will stay in contact with the piston shaft 120, slide down the rear ramp portion 130, and engage the vertical bearing surface 132 to keep the gun 20 in the cocked position.

Figures 4, 6:
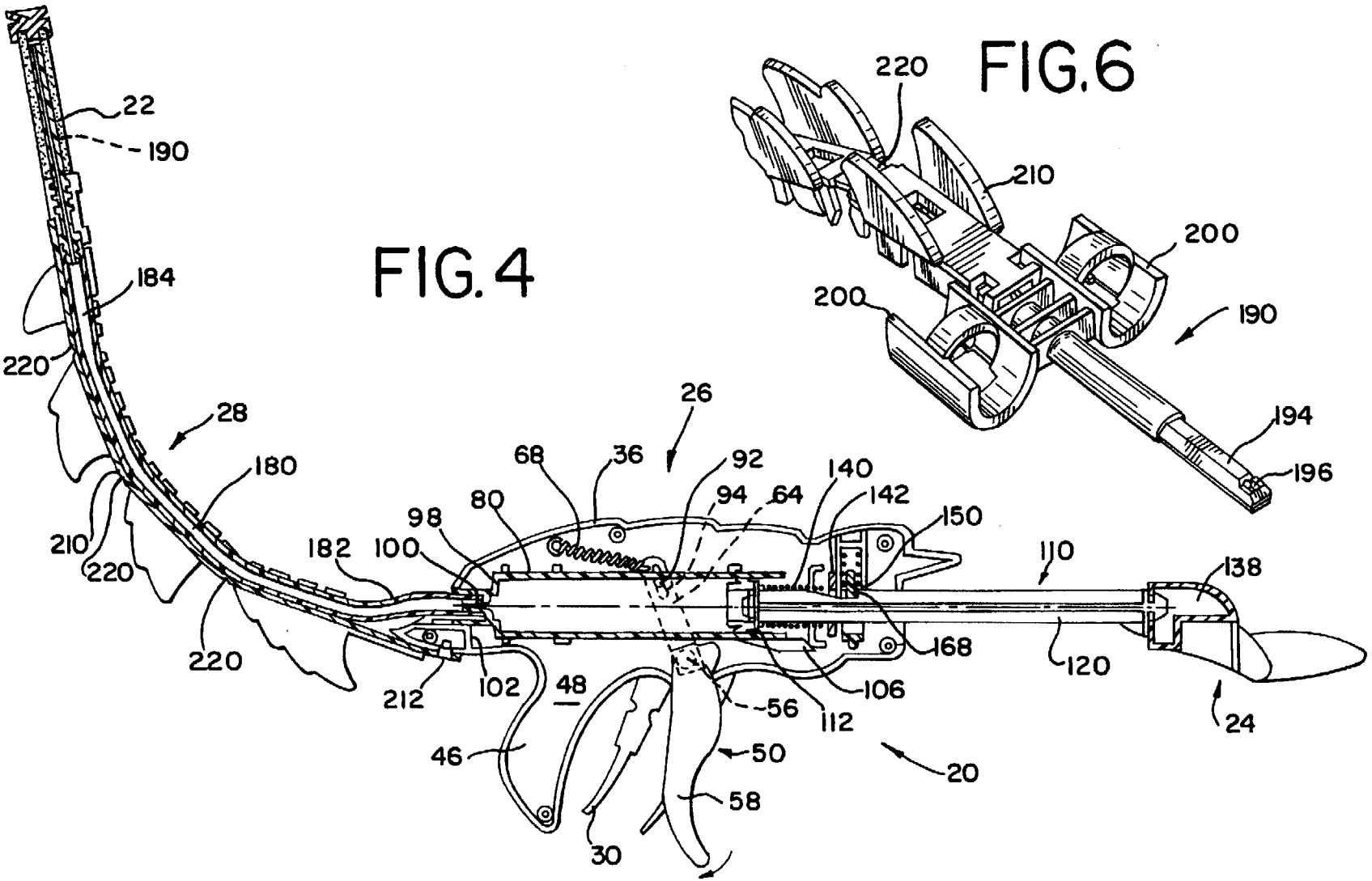
FIG. 4 is a cross-section view of the toy gun in a cocked position and the trigger pulled back partially.
FIG. 6 is a partial perspective view of a launching tip and dart holder for the present invention.

FIG. 4 illustrates the change in position the gun components experience as the operator begins squeezing the trigger 50 so that the trigger lower portion 58 moves rearward and the trigger pivots about pivot point 56. The trigger upper portion 64 will begin to pivot forward which pulls on cylinder pivot pins 92 with slots 94 to move the cylinder 80 forward against the urging of trigger spring 68. Because the piston 110 and the sear 150 are not engaged to the cylinder 80, no movement of the piston 110 will occur except that the cylinder 80 will slide over the piston seal 112. Further, because the ramped release 106 is spaced-apart from the sear 50 in the normal condition (FIG. 2), pulling the trigger 50 only half-way back (FIG. 3) is insufficient to trip the sear 150.

Figure 5:
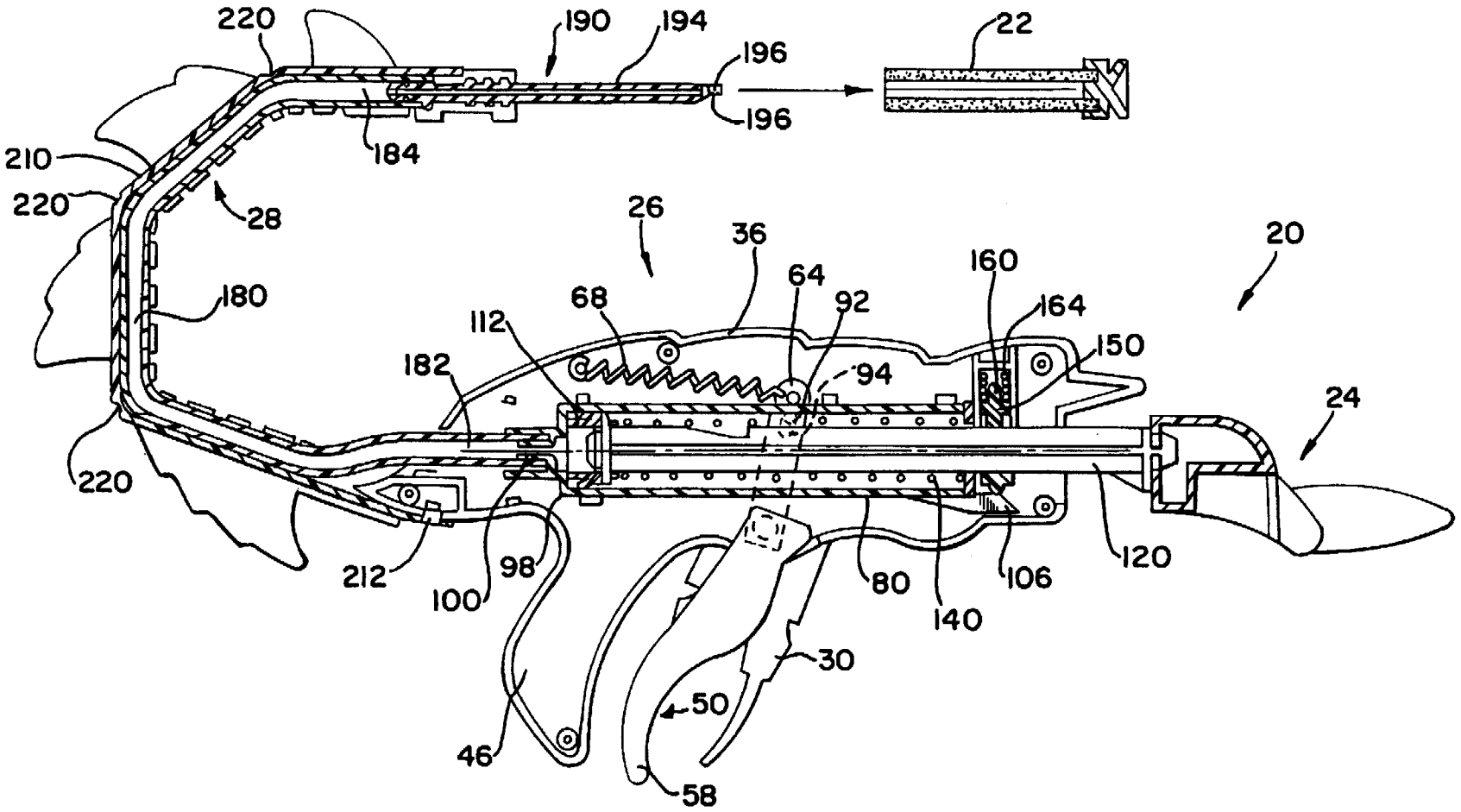
FIG. 5 is a cross-sectional view of the toy gun after the trigger has been pulled back completely to aim and launch foam dart.

FIG. 5 illustrates the toy gun 20 with the trigger 50 pulled back completely, which pushes the cylinder 80 forward to the point that the cylinder's ramped release 106 forces the sear 150 upward against the urging of the sear spring 164. The sear 150 moves upward until the engagement bar 168 clears the piston shaft's vertical bearing surface 132 and the piston spring 140 snaps the piston 110 rearward. As a result of this rearward movement and the small opening in the take-off nipple 100, the piston seal 112 compresses air in the cylinder 80. The compressed gas is then released in a burst through take-off nipple 100. By releasing the trigger 50, the gun components return to the configuration illustrated in FIG. 2.

The compressed gas that is emitted through the take-off nipple 100 is fed to a flexible hose 180 which has a proximate end 182 that is fitted over and fixed to the take-off nipple 100 using any conventional means such as a compression fitting nut 186. The flexible hose 180 extends outward of the rear end 40 of the housing 36. When the cylinder 80 moves forward and rearward, the proximate end 182 of the flexible hose 180 moves also. The hose 180 also includes a distal portion 184 that hangs free of the housing 36.

As best illustrated in FIG. 6, the hose's distal portion 184 has fitted to it a launch tip 190 that is relatively rigid for supporting a projectile such as a foam dart 22 in preparation for firing. The launch tip 190 includes a male portion (not illustrated) inserted into the distal end of the flexible hose 180. A launching end 194 includes two holes 196 opening vertically transversely from the launching end 194 to provide a more uniform distribution of compressed gas. Further benefitting uniform distribution of compressed gas is the hexagonal shape of the launch tip 190 which will define chambers with the inside diameter of the foam dart 27 through which compressed gas may flow. The launch tip 190 is preferably molded integrally with two projectile holders 200 for storing foam darts (for example) when not in use.

Referring to FIGS. 4 and 5, secured to the rear end 40 of the housing 36 is a tail assembly 28 that includes the flexible hose 180 and a tail 210. The tail 210, preferably made of high-density polyethylene, is flexible and will bend when the trigger 50 is pulled. The tail 210 has a proximate end fixed to the housing 36 preferably using a tab 212 locked into a T-shaped opening 216 in the housing 36 which is positioned below and spaced apart from the flexible hose 180 to define a lever arm. The tail 210 also is secured to the distal portion 184 of the flexible hose 180. The tail 210 includes hinges 220 that are molded integrally with the tail 210 as "living hinges," but may be other types of hinges or the tail 210 can be continuously flexible along its length. A number of hose guides 226 (FIG. 1) maintain close contact of the hose 180 and tail 210, while permitting sliding relative movement of the hose 180 relative to the tail 210.

In this configuration, the tail 210 will bend upward as the trigger 50 is pulled because pulling the trigger 50 moves the cylinder 80 forward which pulls the proximate end 182 of the flexible hose 180 forward. Because the tail 210 is secured to the distal portion 184 of the flexible hose 180 tension will be applied to the flexible hose 180. The resulting tension in the flexible hose 180 acts in combination with the lever arm to bend the tail 210 into a curve.

Preferably, the tail 210 and flexible hose 180 bend to such an extent as to direct the launch tip 190 forward and over the top of the gun 20 so that the projectile 22 is fired forward. To do this, the cylinder 80 must slide forward a sufficient distance to give the required degree of curvature before the piston 110 is released from the cocked position. This is accomplished by spacing the ramped release 106 apart from the sear 150 to require the trigger to be pulled to nearly the extreme end of its pivoting range before the ramped release 106 disengages the sear 150. Once the tail 210 curves to the extent desired, the piston 110 will be released as described above to launch the projectile 22. The ramped release 106 is illustrated as being fixed to the cylinder 80, but it can be adjustable so that varying degrees of trigger pull and tail curvature are possible prior to the ramp release 106 tripping the sear 150 for additional play value and challenge.

Further, quickly pulling the trigger 50 can cause the tail to "whip" forward more than it would bend if the trigger 50 were pulled slowly. This varied response to different rates of trigger pull adds play value and challenge to firing the toy gun accurately.

In other embodiments, the tail 210 can be replaced by other appendages. As used in the claims, the term "tail" is intended to include other types of appendages. Further, the tail 210 can be designed to bend in other directions by fixing the proximate end of the tail 210 at different positions relative to the flexible hose 180. For example, fixing the tail 210 to the housing 36 above the flexible hose 180, pulling the hose 180 will cause the tail 210 to bend downward. The shape and flexibility of the tail will also affect the direction and degree of bending.

Further, it is possible to use more than one flexible hose as part of a single tail assembly so that the tail can bend in more than one direction (not illustrated). In such an embodiment, the tail will bend in a particular direction depending upon which flexible hose is tensioned. Selective tensioning of hoses is possible using a tensioning means such as dedicated sliding cylinders for each tube.

Another tensioning means could include a twist handle with a shaft joined to the housing for axial rotation relative to the tail. In an example of this embodiment, two flexible tubes are attached to the shaft on opposing sides of the shaft so that twisting the shaft in one direction tensions one hose and twisting the shaft in the other direction tensions the other hose. The shaft can be part of the trigger so it can be twisted while the trigger is being pulled or it can be mounted separately on the gun housing.

The foregoing detailed description has been provided for clearness of understanding the embodiment of the invention depicted in the drawings and should not be considered as unduly limiting the scope of the claims herein.

What is claimed:

1. A toy gun for launching projectiles with compressed gas, comprising:

a housing defining an internal space;

a trigger pivotally joined to the housing and having means for being pulled;

pressure means for releasing compressed gas in response to the trigger being pulled, the pressure means mounted in the internal space of the housing;

a flexible hose having a proximate end fixed to the pressure means for receiving compressed gas from the pressure means and for transferring the compressed gas to a distal end of the flexible hose positioned outside of the housing to launch a projectile; and means for bending the flexible hose in response to the trigger being pulled.

2. The toy gun of claim 1 and further comprising:

means for bending the flexible hose to a predetermined shape prior to releasing compressed gas to launch a projectile.

3. A toy gun for launching projectiles with compressed gas, comprising:

a housing defining an internal space;

a trigger pivotally joined to the housing and having means for being pulled;

pressure means for releasing compressed gas in response to the trigger being pulled, the pressure means mounted in the internal space of the housing and comprising a cylinder disposed in the internal space of the housing; a piston slidably disposed in the cylinder, and having means for being placed in a cocked position and means for compressing gas when released from the cocked position, and means for engaging the piston in the cocked position until the trigger is pulled;

a flexible hose having a proximate end fixed to the pressure means for receiving compressed gas from the pressure means and for transferring the compressed gas to a distal end of the flexible hose positioned outside of the housing to launch a projectile; and means for bending the flexible hose.

4. A toy gun for launching projectiles with compressed gas, comprising:

a housing defining an internal space;

a trigger pivotally joined to the housing and having means for being pulled;

pressure means for releasing compressed gas in response to the trigger being pulled, the pressure means mounted in the internal space of the housing;

a flexible hose having a proximate end fixed to the pressure means for receiving compressed gas from the pressure means and for transferring the compressed gas to a distal end of the flexible hose positioned outside of the housing to launch a projectile; and means for bending the flexible hose comprising:

tensioning means slidably disposed in the internal space of the housing and fixed to the proximate end of the flexible hose, the tensioning means having means for sliding and pulling the flexible hose in response to the trigger being pulled; and a tail having a proximate end fixed to the housing and having a distal portion that is fixed to a distal portion of the flexible hose spaced apart from the proximate end of the flexible hose;

whereby pulling the trigger will slide the tensioning means and pull the flexible hose relative to the fixed proximate end of the tail, apply tension to the flexible hose, and bend the flexible hose and tail.

5. The toy gun of claim 4 in which the tensioning means includes a cylinder and the pressure means comprises:

the cylinder;

a piston slidably disposed in the cylinder, and having means for being placed in a cocked position and means for compressing gas when released from the cocked position;

sear means for engaging the piston in the cocked position; and release means for disengaging the sear means to release the piston from the cocked position, the release means mounted on the cylinder.

6. The toy gun of claim 5 in which the sear means and release means are spaced apart when the trigger is not being pulled; and the cylinder includes means for sliding and bending the tail before the release means disengages the sear means from the piston.

7. The toy gun of claim 4 in which the tail comprises a hinge for bending.

8. The toy gun of claim 4 in which the means for bending the flexible hose includes the trigger.

9. A toy gun for launching projectiles with compressed gas, comprising:

a housing having a front end and a rear end, and defining an internal space;

a trigger pivotally joined to the housing and having means for being pulled;

a cylinder disposed in the internal space, and slidable from the back end of the housing toward the front end of the housing in response to the trigger being pulled, and having a front end and rear end;

means for biasing the cylinder toward the rear end of the housing;

a piston disposed at least partially in the cylinder and slidable between the rear end of the cylinder and a cocked position at the front end of the cylinder, and including means for compressing gas the piston slides toward the rear end of the cylinder;

means for biasing the piston toward the rear end of the cylinder;

a sear disposed in the internal space of the housing, and slidable between a cocked position and a release position, and including means for releasably engaging the piston in the cocked position;

a sear spring for biasing the sear toward the cocked position;

a release mounted on the cylinder for sliding the sear toward the release position to disengage the sear from the piston in response to the trigger being pulled;

a flexible hose for receiving compressed gas from the cylinder and transferring compressed gas to launch a projectile, the flexible hose having a proximate end fixed to the rear end of the cylinder and a distal portion spaced apart from the housing; and a tail having a proximate end fixed to the rear end of the housing and to the distal portion of the flexible hose, the tail having means for bending in response to the cylinder and the proximate end of the flexible hose sliding toward the front end of the housing when the trigger is pulled.

10. The toy gun of claim 9 in which the release is spaced apart from the sear when the trigger is not being pulled, and the cylinder includes means for sliding and bending the tail before the release disengages the sear from the piston.

11. The toy gun of claim 9 in which the proximate end of the tail is fixed to the housing at a location that is spaced apart from the proximate end of the flexible hose.

12. The toy gun of claim 9 in which the proximate end of the tail is fixed to the housing below the flexible hose and tension applied to the flexible hose bends the tail and flexible hose upward and over a top portion of the housing.

13. The toy gun of claim 9 in which the means for bending the tail comprises a hinge.

* * * * *